US006007176A

United States Patent [19]

Askren et al.

[11] Patent Number: 6,007,176

[45] Date of Patent: Dec. 28, 1999

[54] PASSIVE COOLING ARRANGEMENT FOR A THERMAL INK JET PRINTER

[75] Inventors: Benjamin Alan Askren; James Harold Powers, both of Lexington, Ky.

[73] Assignee: Lexmark International, Inc., Lexington, Ky.

[21] Appl. No.: 09/072,832

[22] Filed: May 5, 1998

[51] Int. Cl.[6] ..... B41J 29/377

[52] U.S. Cl. ..... 347/18; 347/93

[58] Field of Search ..... 347/18, 913, 84, 347/17, 67

[56] References Cited

U.S. PATENT DOCUMENTS 5,066,964 11/1991 Fukuda et al. ..... 347/18
5,084,713 1/1992 Wong ..... 346/1.1
5,216,446 6/1993 Satoi et al. ..... 347/18 X
5,272,491 12/1993 Asakawa et al. ..... 347/18
5,576,750 11/1996 Brandon et al. ..... 347/87

*Primary Examiner*—Matthew S. Smith
*Assistant Examiner*—Hoan Tran
*Attorney, Agent, or Firm*—John A. Brady

[57] ABSTRACT

A heater chip of a thermal ink jet printer has its entire surface, which is opposite the parallel surface having resistors for heating ink supplied from a cartridge body to nozzles in a nozzle plate, supported by and engaged with a surface of a base of a high thermally conductive radiator. The radiator, which is submerged in the ink in the cartridge body, has fins, which preferably have a surface area greater than the surface area of the base, extending upwardly from the base of the radiator. The cartridge body has surfaces, which are exposed to the ambient, with a surface area preferably greater than the surface area of the fins. Heat is transferred from the heater chip to the radiator base and from the fins of the radiator to the ink. The ink transfers heat to the ambient through the cartridge body.

15 Claims, 3 Drawing Sheets

PASSIVE COOLING ARRANGEMENT FOR A THERMAL INK JET PRINTER

FIELD OF THE INVENTION

This invention relates to an arrangement for cooling an ink cartridge of a thermal ink jet printer and, more particularly, to a passive cooling arrangement for removing heat from a heater chip of a thermal ink jet printer.

BACKGROUND OF THE INVENTION

As power and power density requirements of a heater chip of a thermal ink jet printer have increased, operating temperatures of the ink cartridge have reached unacceptably high levels. As the speed of operation increases, the temperature of the ink cartridge rises.

Without a cooling arrangement, unacceptably high operating temperature levels may be reached on the heater chip. For example, it is desired that the heater chip have a maximum temperature below 20° C. above room temperature and have a temperature range of between 10° C. and 50° C. above room temperature.

When the heater chip becomes too hot, its reliability decreases. This includes degradation in print quality.

Accordingly, various cooling arrangements have been suggested for removing waste heat from the heater chip and for keeping the heater chip temperature in a satisfactory range while operating at faster speeds. These cooling arrangements have usually been active cooling devices.

The active cooling devices have typically been forced convection devices requiring fluid pumping with the source of the fluid pumping being a force external to the cartridge. One example of an active cooling device having a pump is disclosed in U.S. Pat. No. 5,084,713 to Wong.

SUMMARY OF THE INVENTION

The cooling arrangement of the present invention utilizes a passive cooling device to reduce the relative cost in comparison with active cooling devices. The cooling arrangement of the present invention also simplifies the manufacture of the thermal ink jet cartridge having the heater chip.

It has been determined that the size of the vapor bubble increases along with the temperature of the heater chip. Since the vapor bubble provides the driving force for ink drop ejection, the ink drop mass also increases with heater chip temperature. It also has been determined that the steady state temperature of the heater chip should be maintained as low as possible while the resistors on the heater chip can still selectively vaporize the ink to produce droplets at each nozzle.

It has been discovered that one means of reducing the steady state temperature of the heater chip is to increase the time constant associated with temperature change. A relatively high time constant refers to the relatively long period of time for the heater chip to reach its steady state temperature.

Accordingly, the cooling arrangement of the present invention increases the time for the temperature of the heater chip to rise to its steady state temperature.

The cooling arrangement of the present invention increases the time over which the temperature of the heater chip rises while minimizing the steady state temperature of the heater chip through disposing a high-surface-area body (radiator) of a relatively high thermal diffusivity material, which is a material having a high conductance and a low specific heat, as close as possible to the heater chip and at the base of the filter tower to transfer heat away from the heater chip. Three suitable examples of a relatively high diffusivity material are aluminum, zinc, and magnesium.

To achieve a desired temperature/time profile in which the rise time of the temperature of the heater chip is maximized while minimizing the steady state temperature of the heater chip, the radiator has a base with its cross sectional area as thick as possible.

The cooling arrangement of the present invention also utilizes a relatively high specific heat material, which is the ink, having a large surface area to absorb heat. This cooling arrangement conducts heat from the heater chip into ink residing in the cartridge body. Thermal contact with the ink is insured by the large surface area fin arrangement extending upwardly from the base of the radiator.

The ink has a high thermal capacity so that its temperature rises gradually as heat is transferred to it from the fins of the radiator. The fins of the radiator preferably have a surface area greater than the contact area of the radiator with the heater chip. Thus, the fins of the radiator have a larger area for transferring heat to the ink than that of the contact area of the radiator with the heater chip. It should be understood that it is only necessary for the fins of the radiator to have a surface area greater than the contact area of the radiator with the heater chip to enable efficient transfer of heat from the heater chip to the ink in the reservoir.

To effectively transfer the heat to the ambient from the ink through the cartridge body, the cartridge body preferably has a surface area exposed to the ambient several times that of the surface area of the fins of the radiator. It should be understood that it is only necessary for the cartridge body to have a surface area greater than the surface area of the fins of the radiator to enable efficient transfer of heat from the fins of the radiator to the cartridge body.

The cooling arrangement of the present invention also seeks to maximize the engaging surface area between the radiator and the heater chip, which is preferably silicon. This is accomplished through having the base surface of the radiator engage at least one-half of the back side of the heater chip. The back side is the side opposite the heater resistors.

An object of this invention is to use a passive cooling device for removing heat from a heater chip and filter tower of a thermal ink jet printer.

Other objects of this invention will be readily perceived from the following description, claims, and drawings.

BRIEF DESCRIPTION OF THE DRAWINGS

The attached drawings illustrate a preferred embodiment of the invention, in which.

DETAILED DESCRIPTION OF PREFERRED EMBODIMENT

Figure 1:
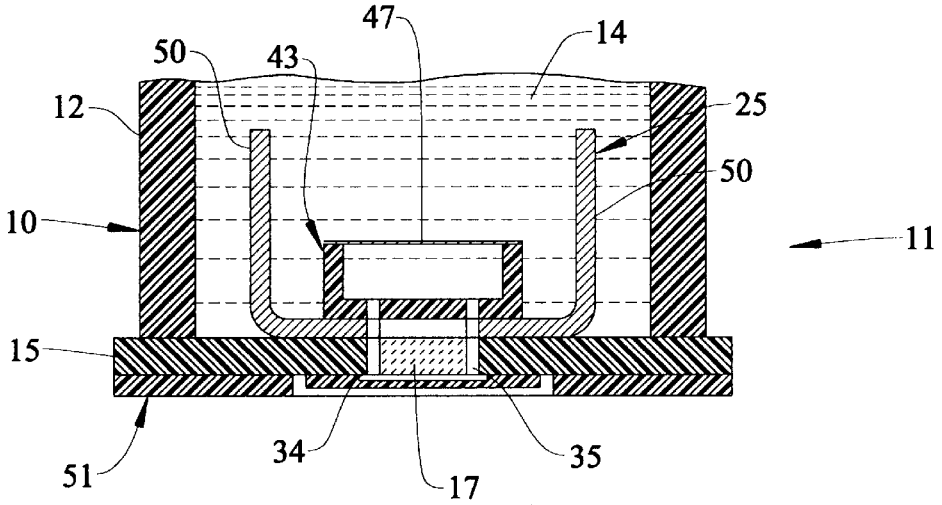
FIG. 1 is a sectional view of a portion of a cartridge of a thermal ink jet printer having a passive cooling arrangement of the present invention.

Referring to the drawings and particularly FIG. 1, there is shown a portion of an ink cartridge 10 of a thermal ink jet printer 11. The cartridge 10 includes a body 12, which is a thermoplastic, having ink 14 stored therein. The interior of the cartridge body 12 has a negative pressure.

The upper end (not shown) of the cartridge body 12 is closed by suitable means (not shown). A rectangular shaped spacer 15, which may be formed of aluminum, ceramic, or plastic, closes the bottom end of the body 12.

Figure 3:
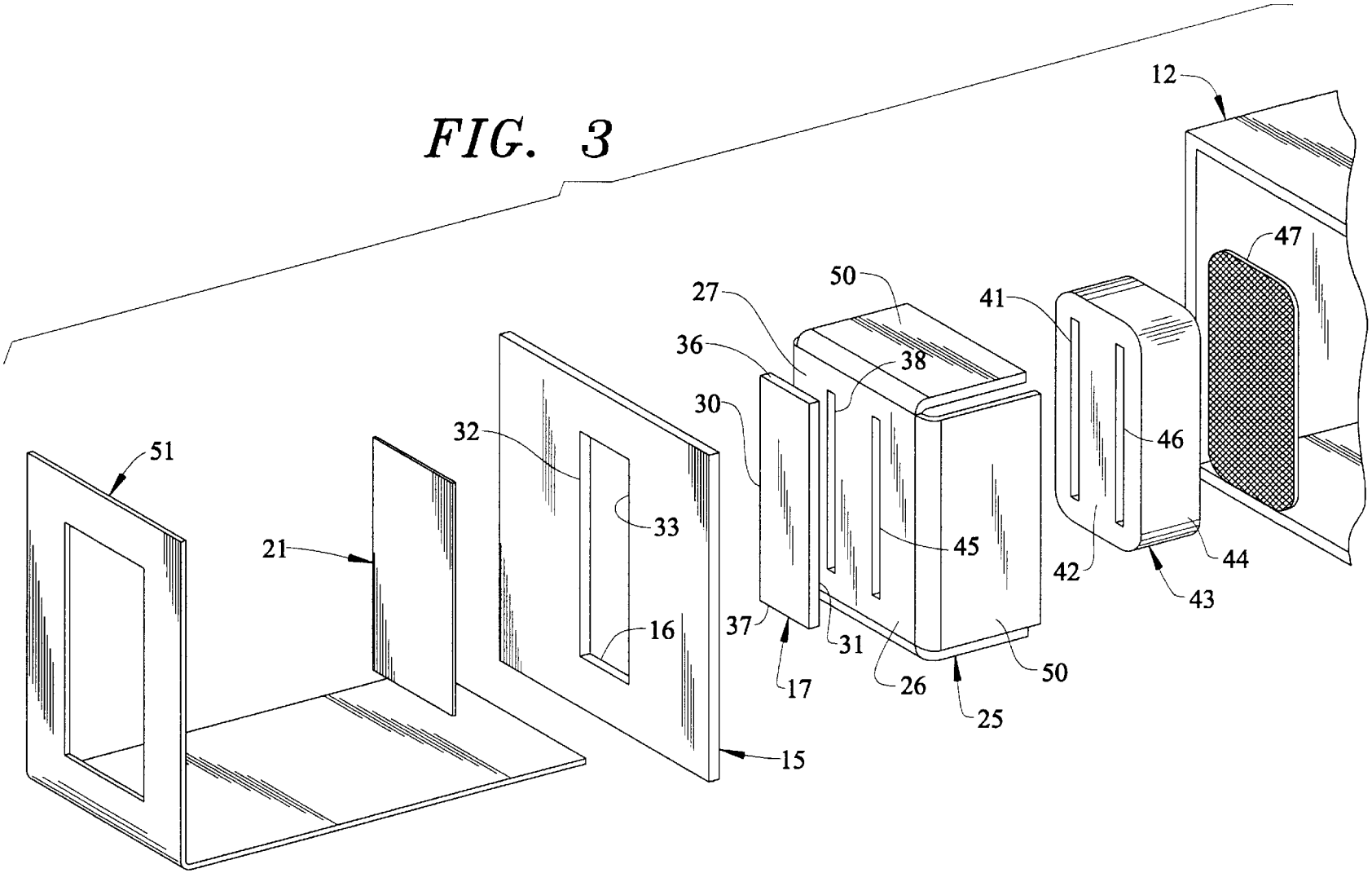
FIG. 3 is an exploded perspective view of the passive cooling arrangement of FIG. 1 including the tab circuit and taken at a different angle than FIG. 2 with resistors on a heater chip and nozzles on a nozzle plate omitted for clarity purposes.

The spacer 15 has a rectangular shaped opening 16 (see FIG. 3) within which a heater chip 17 is disposed. The heater chip 17, which is preferably formed of silicon, has a plurality of resistors 18 (one shown in FIG. 4) formed in its bottom surface 19.

The bottom surface 19 of the heater chip 17 is disposed in the same horizontal plane as a bottom surface 20 of the spacer 15. Thus, the bottom surfaces 19 and 20 form a straight bottom surface.

A nozzle plate 21 is adhered to the bottom surface 19 of the heater chip 17 and the bottom surface 20 of the spacer 15 by an adhesive. The nozzle plate 21 has a plurality of nozzles 22 (one shown in FIG. 4) formed therein. Each of the nozzles 22 is disposed adjacent one of the resistors 18 in the bottom surface 19 of the heater chip 17. As an example, the preferred embodiment has six hundred of the resistors 18 and six hundred of the nozzles 22.

Figure 2:
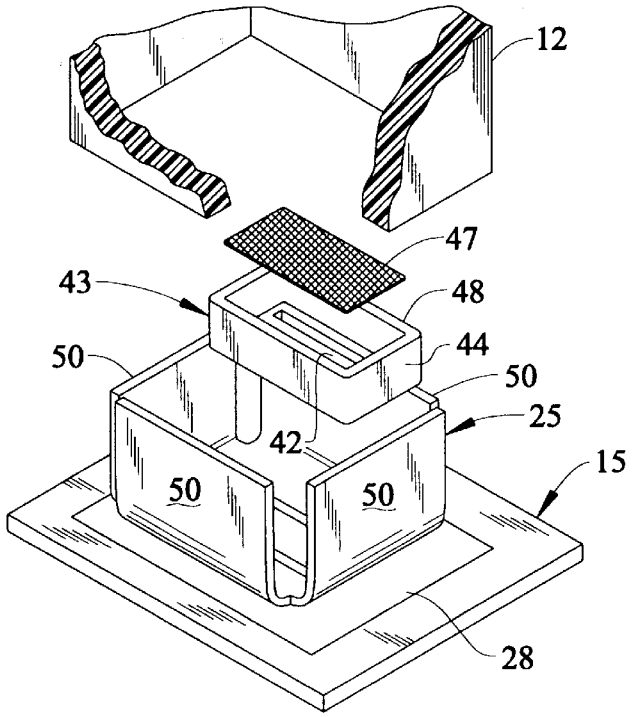
FIG. 2 is an exploded perspective view of the passive cooling arrangement of FIG. 1 with a tab circuit omitted.

A rectangular shaped radiator 25 (see FIG. 3), which may be formed of any suitable high diffusivity material such as aluminum, zinc, or magnesium, for example, includes a base 26 having its bottom surface 27 supported on upper surface 28 (see FIG. 2) of the spacer 15 and attached thereto by adhesive. The bottom surface 27 (see FIG. 4) of the base 26 of the radiator 25 overlies all of upper surface 29 of the heater chip 17 and has the upper surface 29 of the heater chip 17 attached thereto by an adhesive. The upper surface 29 of the heater chip 17 is substantially parallel to the bottom surface 19.

When the heater chip 17 (see FIG. 3) is disposed within the opening 16 in the spacer 15 and has the bottom surface 19 (see FIG. 4) adhered to the bottom surface 27 of the base 26 of the radiator 25, longitudinal side edges 30 (see FIG. 3) and 31 of the heater chip 17 are spaced from corresponding side edges 32 and 33, respectively, of the opening 16 in the spacer 15 to produce a pair of longitudinal passages 34 (see FIG. 1) and 35. End edges 36 (see FIG. 3) and 37 of the heater chip 17 abut corresponding end edges of the opening 16 in the spacer 15.

Figure 4:
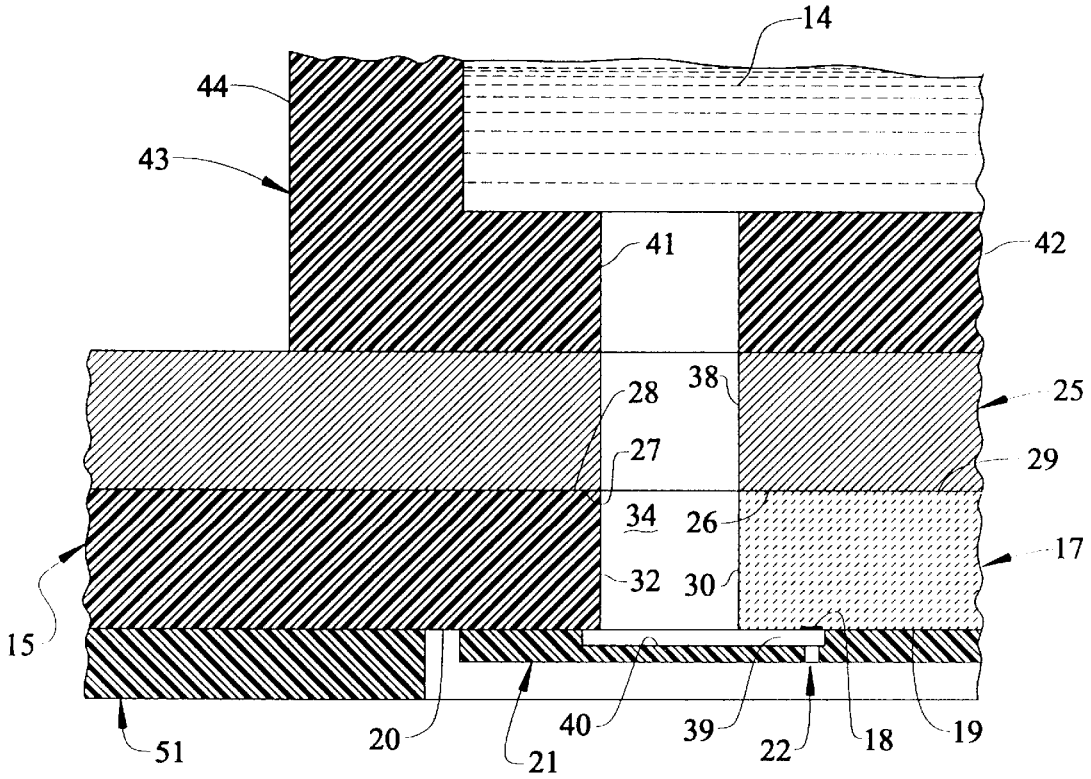
FIG. 4 is an enlarged fragmentary cross-sectional view of a portion of the part of the cartridge illustrated in FIG. 1.

As shown in FIG. 4, the passage 34 communicates at its upper end with a first passage 38 extending through the base 26 of the radiator 25. The passage 34 has its bottom end communicating with a plurality of separate passages 39, which are formed by grooves 40 in the nozzle plate 21 and the overlying bottom surface 19 of the heater chip 17 cooperating with each other.

The upper end of the first passage 38 communicates with a first passage 41 extending through a bottom wall 42 of a rectangular shaped support body 43 (see FIG. 2), which is known in the art as a tower. The support body 43 has vertical walls 44 extending upwardly from the bottom wall 42 and integral therewith.

The passage 35 (see FIG. 1) communicates at its upper end with a second passage 45 (see FIG. 3) extending through the base 26 of the radiator 25. The passage 35 has its bottom end communicating with a plurality of the separate passages 39 (see FIG. 4) in the same manner as the passage 34. The upper end of the second passage 45 (see FIG. 3) communicates with a second passage 46 extending through the bottom wall 42 of the filter tower 43 in the same manner as the passages 38 and 41 communicate as shown in FIG. 4.

The filter support body 43, typically known as a tower, (termed filter tower herein) (see FIG. 3), which is formed of a thermally insulating material such as polyethylene, for example, has a filter 47 attached to its open upper end 48 so that the filter tower 43 is substantially hollow. The filter 47 is formed of a stainless steel mesh so that polyethylene, which has a low melt temperature, can be heated to melt sufficiently enough for the filter 47 to bond to the support body 43. Bottom wall 42 of filter tower 43 contacts radiator 25 and is bonded to radiator 25, as by adhesive.

Thus, the ink 14 (see FIG. 1) within the body 12 flows through the filter 47 into the closed interior of the filter tower 43. Then, the ink 14 flows from the filter tower 43 through the passages 41 (see FIG. 4) and 46 (see FIG. 3) extending through the bottom wall 42 of the body 43, the passages 38 and 45 extending through the base 26 of the radiator 25, and the passages 34 (see FIG. 1) and 35. The ink 14 (see FIG. 4) flows from the passages 34 and 35 (see FIG. 1) into the separate passages 39 (see FIG. 4) to supply the nozzles 22 in the nozzle plate 21. Alternatively, as is common, instead of passages 34 and 35, the geometry may be changed so that corresponding passages are in chip 17.

The radiator 25 (see FIG. 3) has four fins or side walls 50 extending upwardly from the base 26. As shown in FIG. 1, the fins 50 are spaced from inner surfaces of the cartridge body 12 so that the ink 14 is disposed on each side of the fins 50 to conform therewith. This arrangement of the fins 50 with the ink 14 on each side thereof provides a maximum surface area between the fins 50, which are formed of the high thermal diffusivity material, and the ink 14, which is a high specific heat material. This high surface area compensates for the typically low thermal diffusivity of the high specific heat material to improve the efficiency of heat transfer to the ink 14 from the fins 50 of the radiator 25.

By forming the filter tower 43 of a thermally insulating material such as polyethylene, for example, localized thermal isolation is provided between the ink 14 flowing through the filter 47 and the filter tower 43 to the separate passages 39 (see FIG. 4) supplying the ink 14 to the nozzles 22 in the nozzle plate 21. Prior to the steady state operation, the ink 14 flowing to the nozzles 22 is cooler than the remainder of the ink 14 within the cartridge body 12 because of the thermal isolation produced by the thermally insulating material of the filter tower 43. As shown in FIG. 1, the fins 50 extend upwardly substantially beyond the filter 47.

Additionally, the body 43 also prevents any of the ink 14 which is contacting the fins 50 of the radiator 25 from passing directly into the passages 34 and 35. This results in the ink 14 being substantially uniformly heated by the heater chip 17.

A (tape automated bonded) tab circuit 51 (see FIG. 4) is supported by the spacer 15. Adhesive is employed to attach the tab circuit 51 to the spacer 15.

The tab circuit 51 has terminals (not shown) by means of which electrical signals are supplied to control ejection of the ink 14 (see FIG. 4) as droplets, when heated by the resistors 18, through the nozzles 22 in the nozzle plate 21. The use of the tab circuit 51 is described in U.S. Pat. No. 5,576,750 to Brandon et al, which is incorporated by reference herein.

Disposing the radiator 25 (see FIG. 1) of a high thermal diffusivity material between the cartridge body 12 and the filter tower 43 produces a relatively high time constant before the heater chip 17 reaches its steady state temperature. This relationship of time and temperature is shown by a curve 52 in FIG. 5. The curve 52 has a relatively long, slow rise until the heater chip 17 (see FIG. 3) reaches its steady state temperature.

The long rise time for the temperature of the heater chip 17 to reach its steady state, as shown by the curve 52 (see FIG. 5), eliminates the need for any active cooling device such as a pump, for example. The long rise time before the heater chip 17 (see FIG. 3) reaches its steady state temperature insures that the steady state temperature of the heater chip 17 is much less than shown in a curve 53 (see FIG. 5).

The curve 53 represents the temperature of a heater chip relative to time when there are no design features for cooling. The curve 53 discloses a relatively low time constant, which is the time that it takes for a heater chip without cooling to attain its steady state temperature.

As shown by the curve 52, the steady state temperature of the heater chip 17 is at a temperature of less than 20° C. above room temperature. The curve 53 shows a steady state temperature of about 50° C. above room temperature for a heater chip without cooling.

The fins 50 (see FIG. 3) of the radiator 25 are bent up on the edges of the base 26 of the radiator 25 for ease in manufacture. This also enables the radiator 25 to be formed as one piece to reduce any heat conduction impediments, which would be created if the fins 50 were separate pieces attached to the base 26.

When there has been no printing for a period of time, the ink 14 (see FIG. 1) is at its initial or start temperature when a print operation begins. As a print operation begins, the ink 14 flowing through the filter 47 is at its initial or start temperature.

Figure 5:
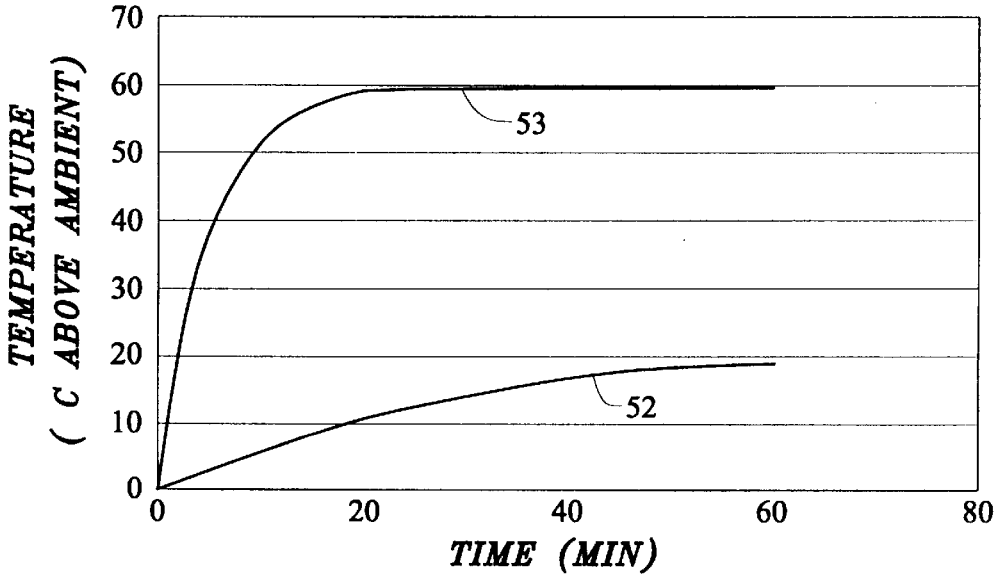
FIG. 5 is a graph showing the relationship of the temperature of a heater chip with respect to time from start of a print operation until its steady state temperature is reached with one curve representing the relationship of the absence of cooling and the other curve representing the relationship for the passive cooling arrangement of the present invention.

When printing begins, the temperature of the heater chip 17 starts to rise as shown by the curve 52 (see FIG. 5). Because of the bottom surface 27 (see FIG. 3) of the base 26 of the radiator 25 engaging the entire upper surface 29 (see FIG. 4) of the heater chip 17, heat is transferred from the heater chip 17 to the base 26 of the radiator 25 to heat the radiator 25.

Because of the radiator 25 being submerged in the ink 14 (see FIG. 1), heat is transferred to the ink 14 by conduction and convection from the radiator 25 primarily by the fins 50. The surface area of the fins 50 of the radiator 25 in contact with the ink 14 is preferably substantially greater, such as two or three times greater, than the surface area of the base 26 (see FIG. 3) of the radiator 25 in contact with the heater chip 17.

However, it should be understood that it is not necessary for the fins 50 of the radiator 25 to have a surface area greater than the surface area of the base 26 of the radiator 25 to enable transfer of the heat from the base 26 of the radiator 25 to the fins 50 of the radiator 25.

Because the ink 14 (see FIG. 1) has a low thermal diffusivity, it takes a relatively long period of time for the ink 14 to gradually heat up. It also takes longer for the ink 14 in the center of the cartridge body 12 to heat up than the ink 14 adjacent the radiator 25.

The surface area of the cartridge body 12 is preferably substantially greater, such as two or three times greater, than the surface area of the fins 50 of the radiator 25. This produces a much larger area for conductive and convective cooling of the ink 14. Therefore, the cartridge body 12 has the capability of dissipating heat from the ink 14 so that the temperature of the ink 14 does not increase substantially.

However, it should be understood that it is not necessary, although it is desirable, for the cartridge body 12 to have a surface area greater than the surface area of the fins 50 of the radiator 25 to enable transfer of heat from the fins 50 of the radiator 25 to the cartridge body 12.

It should be understood that the heater chip 17 may be formed of any suitable semiconductor material. It also should be understood that the filter tower 43 may be formed of any suitable formable or moldable material, preferably plastic for cost and manufacturing efficiencies.

While the ink 14 has been described as flowing from the body 43 through two separate passages to the separate passages 39 (see FIG. 4) for supply to the nozzles 22, it should be understood that only one passage or more than two passages may be used, if desired.

An advantage of this invention is that it avoids the need for an active cooling device such as a fluid pump, for example. Another advantage of this invention is that it produces a temperature/time profile in which the rise time of the temperature of the heater chip is increased to a maximum so as to minimize the steady state temperature of the heater chip during a period of operation of the thermal ink jet printer.

For purposes of exemplification, a preferred embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. A thermal ink jet printing apparatus including:

a body for storing ink for printing;

a radiator of relatively high thermal diffusivity material;

a heater chip having a pair of opposing surfaces;

one of said pair of opposing surfaces having a plurality of resistors therein for heating ink to be supplied as droplets for printing when heated;

the other of said pair of opposing surfaces having a predetermined surface area;

said radiator having a first surface having a predetermined surface area in contact with at least one-half of said surface area of the other of said pair of opposing surfaces of said heater chip;

said radiator having additional surfaces of predetermined size submerged within said ink in said body, said additional surfaces receiving heat from said first surface and transferring the heat to the ink in said body;

said body having external surfaces which transfer heat received from said ink to the ambient; and a filter tower forming a closed region with a first opening and a second opening, said first opening having a filter and being located within said ink in said body, said second opening being in contact with said radiator and delivering the ink to said heater chip, said additional surfaces of said radiator being external of said closed region.

2. The apparatus according to claim 1 in which said radiator includes:

a base in contact with about the entire area of said surface area of said other surface of said pair of opposing surfaces; and a plurality of fins extending upwardly from said base for disposition within the ink in said body, said fins having surfaces of a predetermined surface area and said surfaces of said fins constituting said additional surfaces of said radiator.

3. The apparatus according to claim 2 in which said external surfaces of said body have a total surface area greater than the total surface area of said surfaces of said fins.

4. The apparatus according to claim 3 in which said surfaces of said fins of said radiator have a total surface area greater than the surface area of said first surface of said radiator.

5. The apparatus according to claim 4 which also includes:

at least one passage in said base of said radiator communicating with said second opening of said filter tower;

a spacer connected to said body, said spacer supporting said radiator;

at least one of said spacer and said heater chip having passages, equal in number to the number of said passages in said radiator, each of said passages in at least one of said spacer and said heater chip communicating with one of said passages in said radiator.

6. The apparatus according to claim 5 in which:

said fins of said radiator extend upwardly from said base of said radiator beyond said filter;

and said fins of said radiator are spaced inwardly from inner surfaces of said body.

7. The apparatus according to claim 6 in which the material of said radiator is selected from the group consisting of aluminum, zinc, and magnesium.

8. The apparatus according to claim 7 in which said heater chip is silicon.

9. The apparatus according to claim 6 in which said heater chip is silicon.

10. The apparatus according to claim 2 which also includes:

at least one passage in said base of said radiator communicating with said second opening of said filter tower; and said heater chip having passages, equal in number to the number of said passages in said radiator, each of said passages in said heater chip communicating with one of said passages in said radiator.

11. The apparatus according to claim 2 in which:

said external surfaces of said body have a total surface area greater than said surfaces of said fins; and said surfaces of said fins have a total surface area greater than said surface area of said first surface of said radiator.

12. The apparatus according to claim 11 which also includes:

at least one passage in said radiator communicating with said second opening of said filter tower; and said heater chip having passages, equal in number to the number of said passages in said radiator, each of said passages in said heater chip communicating with one of said passages in said radiator.

13. The apparatus according to claim 1 which also includes:

at least one passage in said radiator communicating with said second opening of said filter tower; and a spacer connected to said body, said spacer supporting said radiator;

at least one of said spacer and said heater chip having passages, equal in number to the number of said passages in said radiator, each of said passages in at least one of said spacer and said heater chip communicating with one of said passages in said radiator.

14. The apparatus according to claim 13 in which:

said external surfaces of said body have a total surface area greater than said predetermined size of said additional surfaces of said radiator;

and said predetermined size of said additional surfaces of said radiator has a total surface area greater than said surface area of said first surface of said radiator.

15. The apparatus according to claim 1 in which:

said external surfaces of said body have a total surface area greater than said predetermined size of said additional surfaces of said radiator; and said predetermined size of said additional surfaces of said radiator has a total surface area greater than said surface area of said first surface of said radiator.

* * * * *